US009298116B2

(12) United States Patent
Maetani et al.

(10) Patent No.: US 9,298,116 B2
(45) Date of Patent: Mar. 29, 2016

(54) ELECTROSTATIC CHARGE IMAGE DEVELOPING TONER

(71) Applicant: KYOCERA Document Solutions Inc., Osaka (JP)

(72) Inventors: Ken Maetani, Osaka (JP); Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/549,808

(22) Filed: Nov. 21, 2014

(65) Prior Publication Data

US 2015/0153662 A1 Jun. 4, 2015

(30) Foreign Application Priority Data

Nov. 29, 2013 (JP) ..... 2013-247556

(51) Int. Cl.
*G03G 9/093* (2006.01)
*G03G 9/08* (2006.01)

(52) U.S. Cl.
CPC ..... *G03G 9/08* (2013.01); *G03G 9/0819* (2013.01); *G03G 9/0825* (2013.01)

(58) Field of Classification Search
CPC ..... G03G 9/09307
See application file for complete search history.

(56) References Cited

U.S. PATENT DOCUMENTS

2013/0344432 A1* 12/2013 Matsumoto ..... G03G 13/08 430/123.5
2014/0038097 A1* 2/2014 Tanaka ..... G03G 9/09314 430/110.2
2015/0160576 A1* 6/2015 Sugahara ..... G03G 9/09708 430/108.6

FOREIGN PATENT DOCUMENTS

JP 2004-118009 A 4/2004

* cited by examiner

*Primary Examiner* — Hoa V Le
(74) *Attorney, Agent, or Firm* — Studebaker & Brackett PC

(57) ABSTRACT

An electrostatic charge image developing toner includes a plurality of toner particles each having a toner core, organic particles adhering to a surface of the toner core, and a shell layer covering the toner core and the organic particles. The shell layers contain a thermosetting resin. A number average particle diameter of the organic particles is at least 50 nm and at most 150 nm

9 Claims, 1 Drawing Sheet

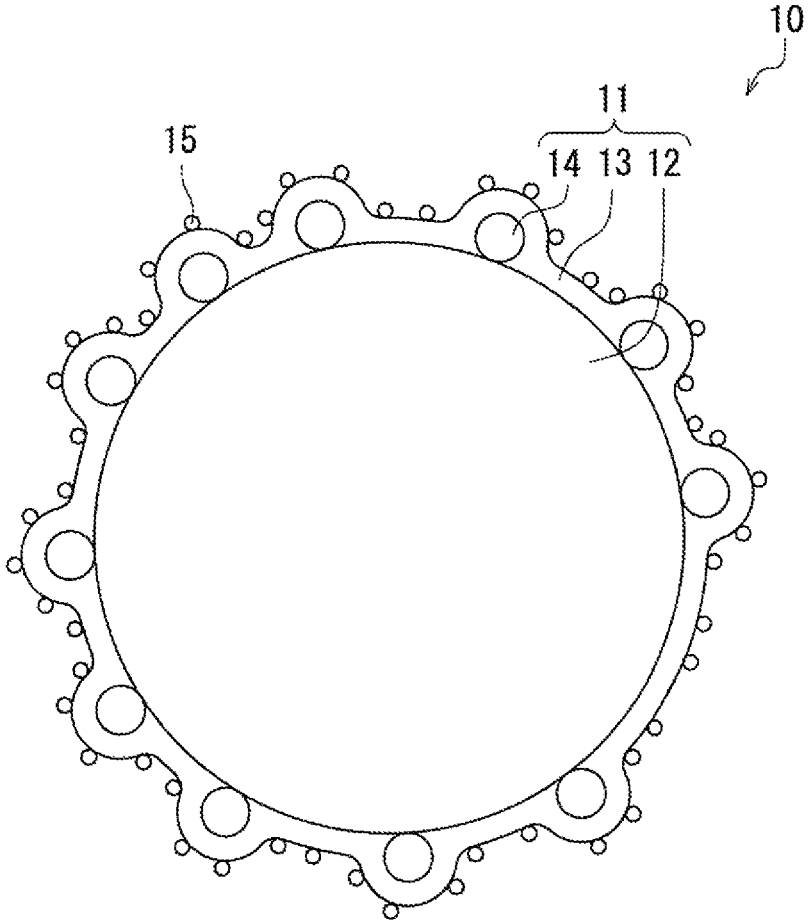
10
11
15
14 13 12

ELECTROSTATIC CHARGE IMAGE DEVELOPING TONER

INCORPORATION BY REFERENCE

The present application claims priority under 35 U.S.C. §115 to Japanese Patent Application No. 2013-247556, filed Nov. 29, 2013. The contents of this application are incorporated herein by reference in their entirety.

BACKGROUND

The present disclosure relates to an electrostatic charge image developing toner.

An electrophotographic method involves exposing the charged surface of a photosensitive drum to light to form an electrostatic charge image on the charged surface of the photosensitive drum. The electrostatic charge image thus formed is developed with toner to form a toner image on the surface of the photosensitive drum. Then, the toner image thus formed is transferred from the photosensitive drum to a recording medium. Through the above, an image is formed on the recording medium.

An electrostatic charge image developing toner includes a plurality of toner particles. The toner may contain an external additive adhering to the surface of the toner particles for improving the fluidity of the toner, the chargeability of the toner, or the ease of toner cleaning. The external additive may be particles of silica or titanium oxide, for example.

Unfortunately, inorganic materials such as silica and titanium oxide tend to exhibit negative chargeability. In view of the above, one suggestion with respect to a positively chargeable toner is to use an external additive containing positively chargeable organic particulates, in addition to the negatively chargeable inorganic particulates.

SUMMARY

An electrostatic charge image developing toner according to the present disclosure includes a plurality of toner particles each having: a toner core; organic particles adhering to a surface of the toner core; and a shell layer covering the toner core and the organic particles. The shell layer contains a thermosetting resin. A number average particle diameter of the organic particles is at least 50 nm and at most 150 nm.

BRIEF DESCRIPTION OF THE DRAWINGS

FIG. 1 shows one of toner particles included in an electrostatic charge image developing toner according to an embodiment of the present disclosure.

DETAILED DESCRIPTION

The following describes an embodiment of the present disclosure. The present disclosure is of course not limited to the embodiment below, and appropriate variations may be made within the scope of the present disclosure to implement the present disclosure. Also note that explanation is omitted where appropriate in order to avoid repetition, but such omission does not limit the gist of the present disclosure.

A toner according to the present embodiment is an electrostatic charge image developing toner. Preferably, the toner according to the present embodiment is used as a positively chargeable toner. With reference to FIG. 1, the following explains the composition of the toner particles included in the toner according to the present embodiment.

The toner according to the present embodiment includes a plurality of toner particles 10, one of which is shown in FIG. 1. Each of the toner particles 10 included in the toner according to the present embodiment has a toner mother particle 11 and an external additive 15. The toner mother particle 11 has a toner core 12, a shell layer 13, and organic particles 14. The organic particles 14 reside on the surface of the toner core 12. The shell layer 13 covers the toner core 12 and the organic particles 14. Note that the external additive may be omitted if unnecessary. When the external additive is omitted, the toner mother particle corresponds to a toner particle. In addition, a plurality of shell layers may be stacked on the surface of the toner core. For a positively chargeable toner, the outermost shell layer is preferably cationic.

The following describes the toner core 12, the shell layer 13, the organic particles 14, and the external additive 15. Note that a generic term "(meth)acrylic acid" may be used to refer to both acrylic acids and methacrylic acids. In addition, a generic term "(meth)acrylate" may be used to refer to both acrylates and methacrylates.

<Toner Cores>

The toner cores 12 contain a binder resin. The toner cores 12 may contain a colorant, a charge control agent, a releasing agent, and/or a magnetic powder as necessary.

[Binder Resin]

Preferable examples of the binder resin contained in the toner cores 12 include thermoplastic resins, such as styrene-based resins, acrylic-based resins, styrene-acrylic-based resins, polyethylene-based resins, polypropylene-based resins, vinyl chloride-based resins, polyester resins, polyamide resins, polyurethane resins, polyvinyl alcohol-based resins, vinyl ether-based resins, N-vinyl-based resins, and styrene-butadiene-based resins. Among the thermoplastic resins listed above, styrene acrylic-based resins and polyester resins are preferable in view of the dispersibility of the colorant in the toner cores 12, the chargeability of the toner, or the fixability of the toner. The following describes styrene-acrylic-based resins and polyester resins.

A styrene acrylic-based resin is a copolymer of a styrene-based monomer and a (meth)acrylic-based monomer. Specific examples of the styrene-based monomer include styrene, α-methylstyrene, vinyltoluene, α-chlorostyrene, o-chlorostyrene, m-chlorostyrene, p-chlorostyrene, and p-ethylstyrene. Specific examples of the (meth)acrylic-based monomer include alkyl esters of (meth)acrylic acid, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

A polyester resin useable as the binder resin is obtained through, for example, condensation polymerization or condensation copolymerization of a dihydric alcohol or an alcohol having three or more hydroxyl groups and a dicarboxylic acid or a carboxylic acid having three or more carboxyl groups.

When the binder resin is a polyester resin, preferable examples of an alcohol usable for synthesis of the polyester resin include diols, bisphenols, and alcohols having three or more hydroxyl groups.

Preferable examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, polyoxyethylenated bisphenol A, and polyoxypropylenated bisphenol A.

Preferable examples of alcohols having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin is a polyester resin, preferable examples of carboxylic acids usable for synthesis of the polyester resin include dicarboxylic acids and carboxylic acids having three or more carboxyl groups.

Preferable examples of dicarboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specifically, n-butyl succinic acid, isobutylsuccinic acid, n-octylsuccinic acid, n-dodecylsuccinic acid, and isododecylsuccinic acid), and alkenyl succinic acids (specifically, n-butenyl succinic acid, isobutenylsuccinic acid, n-octenylsuccinic acid, n-dodecenylsuccinic acid, and isododecenylsuccinic acid).

Preferable examples of carboxylic acids having three or more carboxyl groups include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The dicarboxylic acid or carboxylic acid having three or more carboxyl groups to be used may be modified to an ester-forming derivative, such as an acid halide, an acid anhydride, or a lower alkyl ester. Here, the term "lower alkyl" refers to an alkyl group having one to six carbon atoms.

The softening point (Tm) of the binder resin is not specifically limited. Generally, the softening point (Tm) of the binder resin is preferably at least 60° C. and at most 100° C. and more preferably at least 70° C. and at most 95° C.

The glass transition point (Tg) of the binder resin is preferably at least 50° C. and at most 65° C. and more preferably at least 50° C. and at most 60° C.

[Releasing Agent]

The toner cores 12 may contain a releasing agent as necessary. The releasing agent is used to improve the low-temperature fixability or the offset resistance of the toner, for example.

Preferable examples of the releasing agent include: aliphatic hydrocarbon-based waxes, such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes, such as polyethylene oxide wax and block copolymer of polyethylene oxide wax; plant waxes, such as candelilla wax, carnauba wax, Japan wax, jojoba wax, and rice wax; animal waxes, such as beeswax, lanolin, and spermaceti; mineral waxes, such as ozocerite, ceresin, and petrolatum; waxes having a fatty acid ester as major component, such as montanic acid ester wax and castor wax; and waxes, such as deoxidized carnauba wax in which a part or all of a fatty acid ester has been deoxidized.

The amount of the releasing agent to be used is preferably at least 1 part by mass and at most 30 parts by mass relative to 100 parts by mass of the binder resin, and more preferably at least 5 parts by mass and at most 20 parts by mass.

[Colorant]

The toner cores 12 may contain a colorant as necessary. As the colorant contained in the toner cores 12, a commonly known pigment or dye may be used in accordance with the toner color. The following are specific examples of preferable colorants that can be contained in the toner cores 12.

Carbon black can for example be used as a black colorant. A colorant which is adjusted to a black color using colorants described below, such as a yellow colorant, a magenta colorant, and a cyan colorant, can also be used as the black colorant.

When the toner is a color toner, preferable examples of the colorant contained in the toner cores 12 include a yellow colorant, a magenta colorant, and a cyan colorant.

As yellow colorants, for example, condensed azo compounds, isoindolinone compounds, anthraquinone compounds, azo metal complexes, methine compounds, and arylamide compounds are preferable. Preferable examples of the yellow colorants include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. vat yellow.

As magenta colorants, for example, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds are preferable. Preferable examples of the magenta colorant include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

As cyan colorants, for example, copper phthalocyanine compounds, copper phthalocyanine derivatives, anthraquinone compounds, and basic dye lake compounds are preferable. Preferable examples of the cyan colorants include C.I. pigment blue (1, 7, 15, 15:1, 15:2, 15:3, 15:4, 60, 62, and 66), phthalocyanine blue, C.I. vat blue, and C.I. acid blue.

The amount of the colorant contained in the toner cores 12 is preferably at least 1 part by mass and at most 20 parts by mass relative to 100 parts by mass of the binder resin, and more preferably at least 3 parts by mass and at most 10 parts by mass.

[Charge Control Agent]

The toner cores 12 may contain a charge control agent as necessary. The charge control agent is used to improve the charge stability or the charge rise characteristic of the toner, for example. The presence of the negatively chargeable charge control agent in the toner cores 12 can increase the anionic strength of the toner cores 12. The charge rise characteristics serve as an index indicating whether the toner can be charged to a predetermined charge level within a short period of time.

[Magnetic Powder]

The toner cores 12 may contain a magnetic powder as necessary. Preferable examples of the magnetic powder include iron (specifically ferrite and magnetite), ferromagnetic metals (specifically cobalt and nickel), alloys of either or both of iron and a ferromagnetic metal, ferromagnetic alloys subjected to ferromagnetization (for example, heat treatment), and chromium dioxide.

The magnetic powder preferably has a particle diameter of at least 0.1 μm and at most 1.0 μm, and more preferably at least 0.1 μm and at most 0.5 μm, in order that the magnetic powder can be uniformly dispersed throughout the binder resin.

When the toner is used as a one-component developer, the amount of the magnetic powder contained in the magnetic powder is preferably at least 35 parts by mass and at most 60 parts by mass relative to 100 parts by mass of the toner, and more preferably at least 40 parts by mass and at most 60 parts by mass.

<Shell Layer>

The surface of each of the toner cores 12 is covered by a shell layer 13. For a positively chargeable toner, it is preferable that the resin forming the shell layers 13 is sufficiently cationic (positively chargeable). In addition, in order to improve the strength of the shell layers 13, the resin forming the shell layers 13 is preferably a thermosetting resin.

In order to increase the cationic strength of the shell layers 13, the resin forming the shell layers 13 is preferably a nitrogen-containing resin. A nitrogen-containing material is readily charged positively. The content of nitrogen atoms in the shell layers 13 is preferably 10% by mass or more. As a nitrogen-containing resin, a resin containing an amino group ($-NH_2$) is preferable. Preferable examples of a thermosetting resin containing an amino group include melamine resins, urea resins, sulfonamide resins, glyoxal resins, guanamine resins, aniline resins, polyimide resins, and derivatives of any of the aforementioned resins. A polyimide resin contains nitrogen atoms within the molecular framework thereof. Therefore, when the shell layers 13 contain a polyimide resin, the shell layers 13 tend to be strongly cationic. Preferable examples of a polyimide resin that forms the shell layers 13 include maleimide-based polymers and bismaleimide-based polymers (for example, amino-bismaleimide polymers and bismaleimide triazine polymers). The thermosetting resins listed above may be used alone or in combination of two or more.

The thermosetting resin forming the shell layers 13 can be synthesized using a monomer (shell material) such as melamine, methylol melamine, urea, benzoguanamine, acetoguanamine, or spiroguanamine.

In order to improve the low hygroscopicity and high-temperature preservability of the toner, the resin forming the shell layers 13 is preferably a melamine resin or a urea resin. Both the melamine resin and the urea resin are low in moisture absorption. Thus, the use of a melamine resin or a urea resin as the resin forming the shell layers 13 can restrict the toner particles 10 from sticking together at the time of toner drying. With the toner particles 10 restricted from sticking together, the narrow particle diameter distribution of the toner particles 10 can readily be ensured.

A melamine resin is a polycondens ate of melamine and formaldehyde. A urea resin is a polycondensate of urea and formaldehyde. A glyoxal resin is a polycondens ate of formaldehyde and a reaction product of glyoxal and urea. When the shell layers 13 contain a thermosetting resin and a thermoplastic resin, the monomer for forming the thermosetting resin may be methylolated with formaldehyde before reaction with the monomer for forming the thermoplastic resin.

When the shell layers 13 contain a thermosetting resin and a thermoplastic resin, the thermoplastic resin contained in the shell layers 13 preferably has a functional group that is reactive with a functional group of the thermosetting resin (for example, methylol group or amino group). Specific examples of a functional group that is reactive with a functional group of the thermosetting resin include a functional group containing an active hydrogen atom (specifically, a hydroxyl group, a carboxyl group, or an amino group). The amino group may be a part of a functional group such a carbamoyl group ($-CONH_2$). In order to facilitate formation of the shell layers 13, the thermoplastic resin is preferably a resin containing (meth)acrylamide or a resin containing a monomer having a functional group such as a carbodiimide group, an oxazoline group, or a glycidyl group.

Preferable examples of the thermoplastic resin contained in the shell layers 13 include an acrylic acid ester polymer, a methacrylic acid ester polymer, a styrene-(meth)acrylic-based copolymer, a silicone-(meth)acrylic graft copolymer, polyurethane, polyester, polyvinyl alcohol, and an ethylene vinyl alcohol copolymer. The thermoplastic resin may contain a monomer having a functional group such as a carbodiimide group, an oxazoline group, or a glycidyl group. Among the thermoplastic resins listed above, an acrylic acid ester polymer, a methacrylic acid ester polymer, a styrene-(meth) acrylic-based copolymer, or a silicone-(meth)acrylic graft copolymer is preferable, and an acrylic acid ester polymer or a methacrylic acid ester polymer is more preferable.

Examples of a (meth)acrylic-based monomer that can be used for synthesis of an acrylic acid ester polymer or a methacrylic acid ester polymer include: (meth)acrylic acid; alkyl esters of (meth)acrylic acid, such as methyl (meth)acrylate, ethyl (meth)acrylate, n-propyl (meth)acrylate, and n-butyl (meth)acrylate; aryl esters of (meth)acrylic acid, such as phenyl (meth)acrylate; esters of hydroxyalkyl (meth)acrylic acid, such as 2-hydroxyethyl (meth)acrylate, 3-hydroxypropyl (meth)acrylate, 2-hydroxypropyl (meth)acrylate, and 4-hydroxybutyl (meth)acrylate; (meth)acrylamide; ethylene oxide adduct of (meth)acrylic acid; alkyl ethers of ethylene oxide adduct of (meth)acrylic acid ester (specifically, methyl ether, ethyl ether, n-propyl ether, and n-butyl ether).

The thermoplastic resin contained in the shell layers 13 may be cross-linked by a monomer of the thermosetting resin. The shell layers 13 having such composition will have appropriate flexibility resulting from the thermoplastic resin, as well as appropriate mechanical strength resulting from a three-dimensional cross-linking structure formed by the monomer of the thermosetting resin. This ensures that the shell layers 13 are less likely to be ruptured during high-temperature storage of the toner or transportation of the toner. Yet, the shell layers 13 can be readily ruptured when pressure is applied to the toner for fixing at low temperatures, which ensures softening and melting of the binder resin 11*a* contained in the toner cores 12 to proceed quickly. As a result that the thermoplastic resin contained in the shell layers 13 are cross-linked by a monomer of the thermosetting resin, the high-temperature preservability and low-temperature fixability of the toner is expected to improve.

For the shell layers 13 containing a thermosetting resin and a thermoplastic resin, polymerization of the thermoplastic resin and formation of cross-links by the thermosetting resin are preferably carried out in an aqueous medium in order to restrict elution of the components of the toner cores 12 (such as releasing agent). For this reason, the thermoplastic resin contained in the shell layers 13 is preferably water-soluble.

For the shell layers 13 to contain a thermoplastic resin and a thermosetting resin, in order to improve the high-temperature preservability and low-temperature fixability of the toner, a ratio (Ws/Wp) of the content of the thermosetting resin (Ws) in the shell layers 13 relative to the content of the thermoplastic resin (Wp) in the shell layers 13 is preferably at least 3/7 and at most 8/2, and more preferably at least 4/6 and at most 7/3.

The shell layers 13 preferably have a thickness of at least 1 nm and at most 20 nm, and more preferably at least 1 nm and at most 10 nm With the thickness of 20 nm or less (more preferably 10 nm or less), the shell layers 13 can be readily ruptured in response to heat and pressure applied for fixing the toner to a recording medium, which can restrict an excessive increase in the amount of electric charge of the toner during image formation. With the thickness of 1 nm or more, the shell layer 13 are more resistant to rupturing upon receipt of impact during transportation of the toner, which can restrict an excessive decrease in the amount of electric charge of the toner during image formation.

The thickness of the shell layers 13 can be measured by analyzing TEM images of the toner particles 10 in cross section, by using commercially available image-analyzing software (for example, WinROOF, product of Mitani Corporation).

The shell layers 13 may contain a charge control agent. The presence of the positively chargeable charge control agent in the shell layers 13 can increase the cationic strength of the shell layers 13.

<Organic Particles>

The organic particles 14 reside between the toner core 12 and the shell layer 13. To restrict adhesion of the toner to the photosensitive drum or the development section of the image forming apparatus, it is preferable that the organic particles 14 consist essentially of a resin. Preferable examples of the resin forming the organic particles 14 include a copolymer of a styrene-based monomer and a (meth)acrylic-based monomer and a copolymer of two or more different (meth)acrylic-based monomers. Preferable examples of styrene-based monomers include styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene, and p-chlorostyrene. Preferable examples of (meth)acrylic-based monomers include: alkyl esters of (meth)acrylic acid, such as methyl (meth)acrylate, ethyl(meth)acrylate, propyl(meth)acrylate, n-butyl(meth)acrylate, iso-butyl(meth)acrylate, and 2-ethylhexyl(meth)acrylate; (meth)acrylamide compounds, such as (meth)acrylamide, N-alkyl(meth)acrylamide, N-aryl(meth) acrylamide, N,N-dialkyl(meth)acrylamide, and N,N-diaryl (meth)acrylamide; and methacrylic acid nitrile, such as acrylonitrile and methacrylonitrile.

To prevent the organic particles 14 from being embedded or detached, the number average particle diameter of the organic particles 14 measured according to the following method is preferably at least 50 nm and at most 150 nm and more preferably at least 70 nm and at most 90 nm With the number average particle diameter being too small, the organic particles 14 tend to be embedded in the toner cores 12. With the organic particles 14 being embedded, the charge stability of the toner tends to be lower. On the other hand, with the number average particle diameter being too large, the organic particles 14 are more easily detached from the surface of the toner particles 10. In such a case, the detached organic particles 14 may contaminate the development section or the photosensitive drum of the image forming apparatus, which tends to degrade the quality of images to be formed.

<Method for Measuring Number Average Particle Diameter of Organic Particles>

First, an image of the organic particles 14 (powder) is captured by using a scanning electron microscope. Subsequently, the captured image is analyzed by image analysis software for an appropriate number (for example, ten or more) of organic particles 14 to measure the particle diameter (equivalent circle diameter: diameter of a circle with equivalent projected area as the particle) of each of the organic particles 14 being measured. Subsequently, the sum of all the particle diameters measured is divided by the number of organic particles 14 measured. As a result, the number average particle diameter of the organic particles 14 is obtained.

The number average particle diameter of the organic particles 14 can be adjusted through the adjustment of the preparation conditions (for example, polymerization conditions, pulverization conditions, and classification conditions) of the organic particles 14. For example, the number average particle diameter of the organic particle 14 can be adjusted by changing the amount of a surfactant added for polymerization.

<External Additive>

The external additive 15 may adhere to the surface of the toner mother particle 11 of each toner particle 10. Preferable examples of the external additive 15 include silica and metal oxides (specifically, alumina, titanium oxide, magnesium oxide, zinc oxide, strontium titanate, or barium titanate). The above-listed external additives may be used alone or in combination of two or more.

To reduce the charge amount of the toner in a high temperature and humidity environment or to improve the fluidity of the toner, the external additive 15 may be subjected to a surface-treatment using a hydrophobic agent, such as an aminosilane coupling agent or silicone oil, to impart hydrophobicity.

To improve the fluidity and handling property of the toner, the amount of the external additive 15 to be used is preferably at least 0.1 parts by mass and at most 10 parts by mass relative to 100 parts by mass of the toner mother particles 11, and more preferably at least 0.2 parts by mass and at most 5 parts by mass. In order to improve the fluidity and handling property of the toner, the particle diameter of the external additive 15 is preferably at least 0.01 μm and at most 1.0 μm.

<Method for Manufacturing Electrostatic Charge Image Developing Toner>

The method for manufacturing an electrostatic charge image developing toner involves a first preparation process (preparation of the toner cores 12), a second preparation process (preparation of the organic particles 14), a first adhesion process (adhesion of the organic particles 14), a shell layer forming process, and a second adhesion process (adhesion of the external additive 15). In the first preparation process, the toner cores 12 are prepared. In the second preparation process, the organic particles 14 are prepared. In the first adhesion process, the organic particles 14 are caused to adhere to the surface of the toner cores 12. In the shell layer formation process, the shell layers 13 are formed on the surface of the toner cores 12 having the organic particles 14 adhering thereto. In the second adhesion process, the external additive 15 is caused to adhere to the surface of the toner mother particles 11. Note that the second adhesion process may be omitted if unnecessary.

[First Preparation Process]

In the first preparation process, the toner cores 12 are produced, for example. The toner cores 12 may be produced preferably by using a melt-kneading method or an aggregation method, for example.

The melt-kneading method involves a mixing process, a melt-kneading process, a pulverizing process, and a classifying process. In the mixing process, the binder resin and the internal additive (for example, a colorant and a releasing agent) are mixed to obtain a mixture. In the melt-kneading process, the resultant mixture is melt-kneaded to obtain a melt-knead. In the pulverization process, the resultant melt-knead was pulverized to obtain a pulverized product. In the classification process, the pulverized product was classified to obtain the toner cores 12 having desired particle diameters.

The aggregation method involves an aggregation process and a coalescence process. In the aggregation process, particulates having the components of the toner cores 12 are caused to aggregate in an aqueous medium. As a result, aggregated particles are obtained. In the coalescence process, the components contained in the resultant aggregated particles are caused to coalesce in the aqueous medium. As a result, the toner cores 12 are obtained.

[Second Preparation Process]

In the second preparation process, the organic particles 14 are produced, for example. The following describes an example of a method for producing the organic particles 14. First, an unsaturated monomer (for example, (meth)acrylic-based monomer) for forming the organic particles 14, a surfactant, and an emulsifier are added to an aqueous medium (for example, ion exchanged water, pure water, or methanol) to cause emulsion polymerization of the unsaturated monomer to obtain an emulsion. The resultant emulsion is dried to obtain the organic particles 14 having a desired number average particle diameter. A water-soluble polymer protective colloid (for example, polyvinyl alcohol) may be added to the aqueous medium.

The surfactant may be at least one surfactant selected from the group consisting of a cationic surfactant, an anionic surfactant, and a nonionic surfactant, for example. The surfactant may be a reactive or non-reactive surfactant. The anionic or nonionic surfactant may contain a radically polymerizable allyl group. For example, the surfactant preferably is a reactive anionic surfactant having a radically polymerizable allyl group introduced therein.

Specific examples of cationic surfactant include dodecylammonium chloride, dodecylammonium bromide, dodecyltrimethylammonium bromide, dodecylpyridinium chloride, dodecylpyridinium bromide, and hexadecyltrimethylammonium bromide. Specific examples of anionic surfactants include: fatty acid soaps, such as sodium stearate and sodium dodecanoate; sodium dodecyl sulfate; and salts of sulphonic acid, such as sodium dodecylbenzenesulfonate. Specific examples of nonionic surfactants include polyoxyethylene dodecyl ether, polyoxyethylene hexadecyl ether, polyoxyethylene nonylphenyl ether, polyoxyethylene sorbitan monooleate ether, and monodecanoyl sucrose.

Preferable methods for copolymerizing a styrene-based monomer and a (meth)acrylic-based monomer include solution polymerization, bulk polymerization, emulsion polymerization, and suspension polymerization. Among the above-listed polymerization methods, emulsion polymerization is particularly preferable for producing organic particles 14 having a uniform particle diameter.

A polymerization initiator may be used in the production of the organic particles 14. Specific examples of polymerization initiators include potassium persulfate, acetyl peroxide, decanoyl peroxide, lauroyl peroxide, benzoyl peroxide, ammonium peroxide, azobisisobutyronitrile, 2,2'-azobis-2,4-dimethyl-valeronitrile, and 2,2'-azobis-4-methoxy-2,4-dimethylvaleronitrile. Preferable examples of polymerization initiators for addition polymerization of a monomer having an unsaturated bond include potassium persulfate, acetyl peroxide, decanoyl peroxide, lauroyl peroxide, benzoyl peroxide, azobisisobutyronitrile, 2,2'-azobis-2,4-dimethyl-valeronitrile, and 2,2'-azobis-4-methoxy-2,4-dimethylvaleronitrile. To accelerate the polymerization reaction, the amount of a polymerization initiator to be used is preferably at least 0.1% by mass and at most 15% by mass of the total amount of the styrene-based monomer and the (meth)acrylic-based monomer.

[First Adhesion Process]

In the first adhesion process, the organic particles 14 obtained through the second preparation process are caused to adhere to the surface of the toner cores 12 obtained through the first preparation process. The method for causing the organic particles 14 to adhere to the surface of the toner cores 12 may for example be a method of mixing the toner cores 12 and the organic particles 14 by using a mixer, such as FM mixer (product of Nippon Coke & Engineering Co., Ltd.) or Nauta mixer (product of Hosokawa Micron Corporation), under the conditions ensuring that the organic particles 14 are not embedded in the toner cores 12.

[Shell Layer Formation Process]

The shell layer formation process involves a supply process and a resinification process. The supply process is to supply a shell material (for example, a solution containing a monomer for forming a thermosetting resin) to the surface of the toner cores 12 having the organic particles 14 adhering thereto. The resinification process is to resinify the shell material supplied to the surface of the toner cores 12. Through the supply process and the resinification process, the organic particles 14 are readily caused to uniformly adhere to the surface of the toner cores 12.

Specific example of a method of supplying the shell material to the surface of the toner cores 12 include a method of spraying a solution containing the shell material onto the surface of the toner cores 12 and a method of immersing the toner cores 12 in a solution containing the shell material.

The solvent used to prepare the solution containing the shell material is, for example, toluene, acetone methyl ethyl ketone, tetrahydrofuran, or water.

A dispersant may be added to the solution containing the shell material in order to improve the dispersibility of the toner cores 12. Preferably, the dispersant is contained in an amount small enough to be removable by washing in a subsequent process but sufficient for improving the dispersibility of the toner cores 12. Specifically, a preferable amount of the dispersant to be used is at least 0.1 parts by mass and at most 15 parts by mass relative to 100 parts by mass of the solution containing the shell material. In view of the high environmental load caused by a dispersant, it is preferable to fully remove the dispersant by washing.

Specific examples of dispersants include sodium polyacrylate, polyparavinyl phenol, partially saponified polyvinyl acetate, isoprene sulfonic acid, polyether, a copolymer of isobutylene and maleic acid, sodium polyaspartic acid, starch, gum arabic, polyvinylpyrrolidone, and sodium lignosulfonate. Note that the dispersants listed above may be used alone or in combination of two or more.

In the resinification process, the shell material (monomer or prepolymer) is resinified through polymerization or condensation. Through the above, the shell layers 13 are formed on the surface of the toner cores 12 having the organic particles 14 adhering thereto.

Specific examples of a method of polymerizing the monomer or prepolymer include in-situ polymerization, in-liquid curing coating, and coacervation. The in-situ polymerization is expected to lead to formation of the shell layers uniformly covering the toner cores 12. Through in-situ polymerization, the shell material reacts on the surface of the toner cores 12 to form the shell layers 13.

For the shell layers 13 to have an appropriate degree of hardness (such that the shell layers 13 are not ruptured during storage of the toner but easily ruptured at the time of fixing the toner), the reaction temperature at which the resinification process is carried out (the temperature of the solution at the time of the resinifying reaction) is at least 40° C. and at most 90° C., and more preferably at least 50° C. and at most 80° C.

Through the shell layer formation process, the toner mother particles 11 are obtained. Subsequently to the shell layer formation process, a washing process, a drying process, and a second adhesion process (external addition process) are conducted as necessary to obtain an electrostatic charge image developing toner according to the present embodiment.

In the washing process, the toner mother particles 11 are washed with pure water, for example.

In the drying process, the washed toner mother particles 11 are dried using, for example, a drying apparatus (a spray dryer, a fluid bed dryer, a vacuum freeze dryer, or a reduced pressure dryer). In order to restrict aggregation of the toner mother particles 11 during drying, the use of a spray dryer is particularly preferable. Since the method using a spray dryer involves atomizing a dispersion containing the external additive 15 (for example, silica particles) onto the toner mother particles 11, it is possible to conduct the drying process and the external addition process, which will be described later, at the same time.

[Second Preparation Process]

The toner particles 10 are produced by causing the external additive 15 to adhere to the surface of the toner mother particles 11. In one preferable example of the external addition, the toner mother particles 11 and the external additive 15 are mixed using a mixer, such as FM mixer (product of Nippon Coke & Engineering Co., Ltd.) or Nauta mixer (product of Hosokawa Micron Corporation), under the conditions ensuring that the organic particles 14 are not embedded in the toner cores 12.

EXAMPLES

The following describes Examples of the present disclosure. Note that the present disclosure is in no way limited to the scope of the examples.

Table 1 shows toners (each being an electrostatic charge image developing toner) of Examples 1-10 and Comparative Examples 1-8.

TABLE 1

| | | | Organic Particles | |
|---|---|---|---|---|
| | Toner Cores | Shell Layers | Type | Particle Diameter [nm] |
| Example 1 | Toner Cores A | Shell Layers A | Organic Particles A | 74 |
| Example 2 | Toner Cores A | Shell Layers B | Organic Particles A | 74 |
| Example 3 | Toner Cores A | Shell Layers C | Organic Particles A | 74 |
| Example 4 | Toner Cores B | Shell Layers A | Organic Particles A | 74 |
| Example 5 | Toner Cores C | Shell Layers A | Organic Particles A | 74 |
| Example 6 | Toner Cores D | Shell Layers A | Organic Particles A | 74 |
| Example 7 | Toner Cores A | Shell Layers A | Organic Particles B | 51 |
| Example 8 | Toner Cores A | Shell Layers A | Organic Particles C | 90 |
| Example 9 | Toner Cores A | Shell Layers A | Organic Particles D | 150 |
| Example 10 | Toner Cores A | Shell Layers A | Organic Particles G | 89 |
| Comparative Example 1 | Toner Cores A | Shell Layers A | Organic Particles E | 200 |
| Comparative Example 2 | Toner Cores A | Shell Layers A | Organic Particles F | 41 |
| Comparative Example 3 | Toner Cores A | — | Organic Particles A | 74 |
| Comparative Example 4 | Toner Cores B | — | Organic Particles B | 51 |
| Comparative Example 5 | Toner Cores C | — | Organic Particles C | 90 |
| Comparative Example 6 | Toner Cores D | — | Organic Particles D | 150 |
| Comparative Example 7 | Toner Cores A | Shell Layers A | — | — |
| Comparative Example 8 | Toner Cores A | Shell Layers B | — | — |

Example 1

[Preparation of Toner Cores]

Frist, 100 parts by mass of a polyester resin (TUFTONE (registered Japanese trademark) NE-410, product of Kao Corporation), 5 parts by mass of a colorant (REGAL (registered Japanese trademark) 330R, product of Cabot Japan K.K.), and 5 parts by mass of a releasing agent (VISCOL (registered Japanese trademark) 660P, product of Sanyo Chemical Industries, Ltd.) were mixed by using FM mixer (product of Nippon Coke & Engineering Co., Ltd.) to obtain a mixture. Subsequently, the resultant mixture was melt-knead by using a two screw extruder (Model PCM-30, product of Ikegai Corp.) to obtain a melt-knead. Subsequently, the resultant melt-knead was pulverized by using a mechanical pulverizer (Turbo Mill, product of FREUND-TURBO CORPORATION) to obtain a pulverized product. The resultant pulverized product was classified by using a classifying apparatus (Elbow-Jet, product of Nittetsu Mining Co., Ltd.) to obtain toner cores A having a volume median diameter ($D_{50}$) of 7 μm.

[Preparation of Organic Particles]

A glass reaction vessel equipped with a thermometer, a stirrer, a reflux condenser, and a nitrogen gas inlet tube was set up in a water bath maintained at 80° C. The reaction vessel was charged with 200 parts by mass of ion exchanged water and 3 parts by mass of sodium lauryl sulfate. While the contents of the reaction vessel were maintained at 80° C. and stirred in a nitrogen gas atmosphere, 1 part by mass of ammonium persulfate, 70 parts by mass of methacrylate, and 30 parts by mass of n-butyl acrylate were dripped over 1 hour. Subsequently, the contents of the reaction vessel were maintained at 80° C. and stirred for 1 hour to obtain an emulsion. The resultant emulsion was dried to obtain organic particles A having a number average particle diameter of 74 nm The method for measuring the number average particle diameter is as described above.

[Adhesion of Organic Particles]

Subsequently, 100 parts by mass of the toner cores A produced in the above manner were mixed with 1.5 parts by mass of the organic particles A produced in the above manner by using a mixer (FM-10B, product of Nippon Coke & Engineering Co., Ltd.) at a rotation speed of 3,500 rpm for 5 minutes to cause the organic particles A to adhere to the surface of the toner cores A.

[Shell Layer Formation]

A three-necked flask equipped with a thermometer, a stirrer, and a condenser was set up in a water bath maintained at 30° C. The flask was charged with 300 mL of ion exchanged water, and the pH of the contents of the flask was adjusted to 4 with aqueous hydrochloric acid. Subsequently, 3 mL of an aqueous solution of initial polymer of cross-linking trimethylol melamine (Polyfix (registered Japanese trademark) KAM-7, product of Showa Denko K.K.) was added to the flask. Subsequently, 100 parts by mass of the toner cores A having the organic particles A adhering thereto through the above-described process was added to the flask, along with 50 parts by mass of sodium acrylate (JURYMER (registered Japanese trademark) AC-103, product of Toagosei Co., Ltd.) and 1.0 parts by mass of an aqueous solution of methylolated urea (MIRBANE (registered Japanese trademark) resin SUM-100, product of Showa Denko K.K.). Subsequently, while the contents of the flask were stirred at a rotation speed of 1,200 rpm, the temperature of the contents of the flask was raised up to 70° C. and then maintained at 70° C. for one hour. Then, the contents of the flask were cooled to room temperature. As a result, the shell layers A covering the surface of the toner cores were formed and a dispersion containing toner mother particles was obtained.

Subsequently, the dispersion containing the toner mother particles was filtered through a Buchner funnel to isolate a wet cake of the toner mother particles. Subsequently, the wet cake of the toner mother particles was re-dispersed in ion exchanged water to wash the toner mother particles. The same process involving the use of ion exchanged water was repeated several times to wash the toner mother particles. After the washing, the wet cake of the toner mother particles was dried to obtain the dried toner mother particles.

[External Addition Process]

First, 100 parts by mass of the resultant toner mother particles were mixed with 1.0 parts by mass of titanium oxide particles (EC-100, product of Titan Kogyo, Ltd.) and 0.7 parts by mass of hydrophobic silica particles (RA-200H, product of Nippon Aerosil Co., Ltd.) at a rotation speed of 3,500 rpm for 5 minutes by using a mixer (FM-10B, product of Nippon Coke & Engineering Co., Ltd.). This caused the external additive (titanium oxide particles and silica particles) to adhere to the surface of the toner mother particles. As a result, the toner of Example 1 was obtained.

Example 2

The toner of Example 2 was obtained through the same processes as Example 1 except that the shell layers B were formed instead of the shell layers A.

[Shell Layers B]

The shell layers B were obtained through the same processes as the shell layers A except that partially saponified polyvinyl acetate (GOHSENOL (registered Japanese trademark) GM-14L, product of Nippon Synthetic Chemical Industry Co., Ltd.) was used instead of sodium acrylate (JURYMER (registered Japanese trademark) AC-103, product of Toagosei Co., Ltd.) and that water-soluble methylolmelamine (Nikaresin (registered Japanese trademark) S-260, product of Nippon Carbide Industries Co., Inc.) was used instead of an aqueous solution of methylolated urea (MIRBANE (registered Japanese trademark) resin SUM-100, product of Showa Denko K.K.).

Example 3

The toner of Example 3 was obtained through the same processes as Example 1 except that the shell layers C were formed instead of the shell layers A.

[Shell Layers C]

The shell layers C were obtained through the same processes as the shell layers A except that an aqueous solution of initial polymer of cross-linking trimethylolmelamine (Polyfix (registered Japanese trademark) KAM-7, product of Showa Denko K.K.) was used instead of an aqueous solution of methylolated urea (MIRBANE (registered Japanese trademark) resin SUM-100, product of Showa Denko K.K.) and that sodium acrylate (JURYMER (registered Japanese trademark) AC-103, product of Toagosei Co., Ltd.) was not used.

Example 4

The toner of Example 4 was obtained through the same processes as Example 1 except that the toner cores B were formed instead of the toner cores A.

[Toner Cores B]

The toner cores B were obtained through the same processes as the toner cores A except that the releasing agent used was paraffin wax (HNP-9, product of Nippon Seiro Co., Ltd.) instead of polypropylene wax (VISCOL (registered Japanese trademark) 660P, product of Sanyo Chemical Industries, Ltd.).

Example 5

The toner of Example 5 was obtained through the same processes as Example 1 except that the toner cores C were formed instead of the toner cores A.

[Toner Cores C]

The toner cores C were obtained through the same processes as the toner cores A except that the binder resin used was a polyester resin (XPE258, product of Mitsui Chemicals, Inc.) instead of the polyester resin (TUFTONE (registered Japanese trademark) NE-410, product of Kao Corporation).

Example 6

The toner of Example 6 was obtained through the same processes as Example 1 except that the toner cores D were formed instead of the toner cores A.

[Toner Cores D]

The toner cores D were obtained through the same processes as the toner cores A except that the binder resin used was a styrene-acrylic resin (CPR300, product of Mitsui Chemicals, Inc.) instead of the polyester resin (TUFTONE (registered Japanese trademark) NE-410, product of Kao Corporation).

Example 7

The toner of Example 7 was obtained through the same processes as Example 1 except that the organic particles B were formed instead of the organic particles A.

[Organic Particles B]

The organic particles B were obtained through the same processes as the organic particles A except that the additive amount of sodium lauryl sulfate was 6 parts by mass instead of 3 parts by mass.

Example 8

The toner of Example 8 was obtained through the same processes as Example 1 except that the organic particles C were formed instead of the organic particles A.

[Organic Particles C]

The organic particles C were obtained through the same processes as the organic particles A except that the additive amount of sodium lauryl sulfate was 2 parts by mass instead of 3 parts by mass.

Example 9

The toner of Example 9 was obtained through the same processes as Example 1 except that the organic particles D were formed instead of the organic particles A.

[Organic Particles D]

The organic particles D were obtained through the same processes as the organic particles A except that the additive amount of sodium lauryl sulfate was 0.1 parts by mass instead of 3 parts by mass.

Example 10

The toner of Example 10 was obtained through the same processes as Example 1 except that the organic particles G were formed instead of the organic particles A.

[Organic Particles G]

The organic particles G were obtained through the same processes as the organic particles A except that the unsaturated monomers used were styrene and acrylonitrile instead of methyl methacrylate and n-butyl acrylate, respectively.

Comparative Example 1

The toner of Comparative Example 1 was obtained through the same processes as Example 1 except that the organic particles E were formed instead of the organic particles A.

[Organic Particles E]

The organic particles E were obtained through the same processes as the organic particles A except that of sodium lauryl sulfate was not used.

Comparative Example 2

The toner of Comparative Example 1 was obtained through the same processes as Example 1 except that the organic particles F were formed instead of the organic particles A.

[Organic Particles F]

The organic particles F were obtained through the same processes as the organic particles A except that the additive amount of sodium lauryl sulfate was 9 parts by mass instead of 3 parts by mass.

Comparative Example 3

The toner of Comparative Example 3 was obtained through the same processes as Example 1 except that the shell layers A were not formed.

Comparative Example 4

The toner of Comparative Example 4 was obtained through the same processes as Example 1 except that the organic particles B were formed instead of the organic particles A, the organic particles B were formed instead of the organic particles A, and that the shell layers A were not formed.

Comparative Example 5

The toner of Comparative Example 5 was obtained through the same processes as Example 1 except that the toner cores C were formed instead of the toner cores A, that the organic particles C were formed instead of the organic particles A, and that the shell layers A were not formed.

Comparative Example 6

The toner of Comparative Example 6 was obtained through the same processes as Example 1 except that the toner cores D were formed instead of the toner cores A, that the organic particles D were formed instated of the organic particles D, and that the shell layers A were not formed.

Comparative Example 7

The toner of Comparative Example 7 was obtained through the same processes as Example 1 except that the organic particles A were not used.

Comparative Example 8

The toner of Comparative Example 8 were obtained through the same processes as Example 1 except that the shell layers B were formed instead of the shell layers A and that the organic particles A were not used.

<Evaluation Method>

Samples (toners of Examples 1-10 and Comparative Examples 1-8) were evaluated in the following method.

First, 100 parts by mass of a ferrite carrier and 10 parts by mass of the sample (toner) were stirred using a mixer. As a result, an evaluation developer (two-component developer) was obtained. As the mixer, a powder mixer (Rocking Mixer (registered Japanese trademark), product of Aichi Electric Co., Ltd.) was used.

The ferrite carrier was produced in the following method. First, a solution containing 30 parts by mass of a silicone resin and 200 parts by mass of toluene was sprayed onto 1,000 parts by mass of Mn—Mg ferrite cores having an average particle diameter of 35 μm. Through the above, the surface of each core was coated with the solution. Subsequently, the cores were subjected to a heat treatment at 200° C. for 60 minutes to obtain a ferrite carrier.

The samples (Examples 1-10 and Comparative Examples 1-8) were evaluated for print durability by using the respective evaluation developers prepared in the above manner.

(Print Durability)

A color multifunction peripheral (TASKalfa 500ci, product of KYOCERA Document Solutions Inc.) was used as an evaluation apparatus. The evaluation developer was charged into a black-color development section of the evaluation apparatus and the sample (toner) was charged into a black-color toner container of the evaluation apparatus.

In the print durability test, the evaluation apparatus was caused to successively produce 200,000 prints of an image having a coverage rate of 5.0% in a normal temperature and humidity environment (ambient temperature of 20° C. and relative humidity RH of 50%).

Before and after the print durability test, the evaluation apparatus was operated to produce a print of a sample image including a solid portion and a blank portion on a recording medium (print paper). The image density (ID) of the solid portion of the sample image was measured using a Macbeth reflection densitometer (RD914, product of Sakata Inx Eng. Co., Ltd.). The measured image densities were evaluated according to the following criteria.

The image density of 1.3 or more was evaluated as Very Good, the image density of 1.0 or more and less than 1.3 was evaluated as Good, and the image density of less than 1.0 was evaluated as Poor.

After the print durability test, the development section was detached from the evaluation apparatus and visually inspected for the adhesion of the sample (toner) to the development sleeve. Then, the evaluations were made according to the following criteria.

Good: No adhesion of the toner on the surface of the development sleeve was observed.

Poor: Adhesion of the toner to the surface of the development sleeve was observed.

After the print durability test, the photosensitive drum was detached from the evaluation apparatus and visually inspected for the adhesion of the sample (toner) to the photosensitive drum. Then, the evaluations were made according to the following criteria.

Good: No adhesion of the toner on the surface of the photosensitive drum was observed.

Poor: Adhesion of the toner to the surface of the photosensitive drum was observed.

After the print durability test, the sample (toner) scattered over the development section of the evaluation apparatus was fully collected. The mass of the toner thus collected was measured and the mass of the toner (the toner scattering amount) thus measured was evaluated according to the following criteria.

The toner scattering amount of 100 mg or less was evaluated as Very Good, the toner scattering amount of more than 100 mg and less than 400 mg was evaluated as Good, and the toner scattering amount of 400 mg or more was evaluated as Poor.

(Shell Layer Homogeneity)

The homogeneity of the shell layers was measured through the immersion test as follows. First, the sample (toner) was dispersed in the solution of an anionic surfactant having the pH adjusted to 10. Thereafter, with the sample left immersed therein, the dispersion was maintained at 50° C. for 10 hours. The dispersion was then filtered and the sample (toner) obtained as a result of the filtering was dried.

Before and after the immersion test, the surface condition of the sample (toner) was observed with a scanning electron microscope (JSM-7500F, product of JEOL Ltd.). In addition, before and after the immersion test, the Brunauer-Emmett-Teller (BET) specific surface area of the sample (toner) was measured using a BET specific surface area analyzer (HM MODEL-1208, product of Mountech Co., Ltd.). The homogeneity of the shell layers of the sample (toner) was evaluated based on the change rate of BET specific surface area of the sample (toner) before and after the immersion test. The change rate of BET specific surface area is given by the following formula.

$$\text{Change Rate of BET Specific Surface Area}=S_2/S_1,$$

where $S_1$ denotes the BET specific surface area of the sample (toner) before the immersion test, and $S_2$ denotes the BET specific surface area of the sample (toner) after the immersion test.

The change rate of the BET specific surface area of 1.1 or less was evaluated as Good, and the change rate of the BET specific surface area of more than 1.1 was evaluated as Poor.

<Evaluation Results>

Table 2 gathers the evaluation results of the respective samples (Examples 1-10 and Comparative Examples 1-8).

TABLE 2

| | Toner | | | | Image Density | |
|---|---|---|---|---|---|---|
| | Shell Layer Homogeneity | Scattering Amount [mg] | Adhesion to Sleeve | Adhesion to Photosensitive Drum | Before Print Durability Test | After Print Durability Test |
| Example 1 | 1.08 | 240 | Good | Good | 1.40 | 1.22 |
| Example 2 | 1.05 | 258 | Good | Good | 1.40 | 1.24 |
| Example 3 | 1.03 | 249 | Good | Good | 1.45 | 1.28 |
| Example 4 | 1.01 | 190 | Good | Good | 1.38 | 1.18 |
| Example 5 | 1.01 | 260 | Good | Good | 1.47 | 1.22 |
| Example 6 | 1.02 | 140 | Good | Good | 1.41 | 1.25 |
| Example 7 | 1.08 | 286 | Good | Good | 1.28 | 1.27 |
| Example 8 | 1.04 | 186 | Good | Good | 1.37 | 1.22 |
| Example 9 | 1.05 | 356 | Good | Good | 1.25 | 1.19 |
| Example 10 | 1.09 | 80 | Good | Good | 1.32 | 1.20 |
| Comparative Example 1 | 1.09 | 385 | Poor | Poor | 1.25 | 0.90 |
| Comparative Example 2 | 1.07 | 486 | Good | Good | 1.19 | 1.15 |
| Comparative Example 3 | — | 220 | Poor | Poor | 1.41 | 0.93 |
| Comparative Example 4 | — | 289 | Poor | Poor | 1.24 | 0.96 |

TABLE 2-continued

| | Toner | | | | Image Density | |
|---|---|---|---|---|---|---|
| | Shell Layer Homogeneity | Scattering Amount [mg] | Adhesion to Sleeve | Adhesion to Photosensitive Drum | Before Print Durability Test | After Print Durability Test |
| Comparative Example 5 | — | 180 | Poor | Poor | 1.39 | 0.97 |
| Comparative Example 6 | — | 348 | Poor | Poor | 1.24 | 0.87 |
| Comparative Example 7 | 1.06 | 520 | Good | Good | 1.22 | 1.25 |
| Comparative Example 8 | 1.03 | 460 | Good | Good | 1.21 | 1.27 |

As shown in Table 2, all of the toners of Examples 1-10 were low in the toner scattering amount, the adhesion to the development sleeve, and the adhesion to the photosensitive drum. In addition, as the evaluations of the toners of Examples 1-10 show, sufficiently high-density images (high-quality images) were formed before as well as after the print durability test. It is assumed that the presence of organic particles having an appropriate particle diameter between the toner core and the shell layer contributed to the formation of sufficiently high-density images.

In the toner of Comparative Example 1, the number average particle diameter of the organic particles was 200 nm. As the evaluation results of the toner of Comparative Example 1 show, the organic particles were detached from the surface of the toner cores during the shell layer formation and contaminated the development sleeve and the photosensitive drum.

In the toner of Comparative Example 2, the number average particle diameter of the organic particles was 41 nm. As the evaluation results of the toner of Comparative Example 2 show, the organic particles were embedded into the toner cores during the shell layer formation. In addition, the toner was not appropriately charged during the image formation, leading to a large toner scattering amount.

In the toners of Comparative Examples 3 to 6, the organic particles were exposed on the surface of the toner cores. As the evaluation results of the toners of Comparative Examples 3-6 show, the organic particles were detached from the surface of the toner cores and contaminated the development sleeve and the photosensitive drum.

Neither of the toners of Comparative Examples 7 and 8 contained organic particles. As the evaluation results of the toners of the Comparative Examples 7 and 8 show, neither of the toners was appropriately charged during image formation, leading to a large toner scattering amount. Thus, contamination of the multifunction peripheral was highly noticeable.

What is claimed is:

1. An electrostatic charge image developing toner comprising:

a plurality of toner particles each having a toner core, organic particles adhering to a surface of the toner core, and a shell layer covering the toner core and the organic particles, wherein the shell layers contain a thermosetting resin, and a number average particle diameter of the organic particles is at least 50 nm and at most 150 nm.

2. An electrostatic charge image developing toner according to claim 1, wherein the number average particle diameter of the organic particles is at least 70 nm and at most 90 nm.

3. An electrostatic charge image developing toner according to claim 1, wherein the thermosetting resin is a melamine resin or a urea resin.

4. An electrostatic charge image developing toner according to claim 1, wherein the organic particles contain a copolymer of a styrene-based monomer and a (meth)acrylic-based monomer.

5. An electrostatic charge image developing toner according to claim 4, wherein the (meth)acrylic-based monomer is an alkyl (meth)acrylate, a (meth)acrylamide compound, or a methacrylic acid nitrile.

6. An electrostatic charge image developing toner according to claim 5, wherein the organic particles consist essentially of a copolymer of styrene and acrylonitrile.

7. An electrostatic charge image developing toner according to claim 1, wherein the organic particles include a copolymer of two or more different (meth)acrylic-based monomers.

8. An electrostatic charge image developing toner according to claim 7, wherein the organic particles consist essentially of a copolymer of methyl methacrylate and n-butyl acrylate.

9. An electrostatic charge image developing toner according to claim 1, wherein the electrostatic charge image developing toner is a positively chargeable toner.

* * * * *